US011439862B2

(12) United States Patent
Anderson

(10) Patent No.: US 11,439,862 B2
(45) Date of Patent: Sep. 13, 2022

(54) THERAPEUTIC ISOMETRIC TESTING AND ISOTONIC TRAINING EXERCISE DEVICE

(71) Applicant: Duane Anderson, Wyandotte, MI (US)

(72) Inventor: Duane Anderson, Wyandotte, MI (US)

( * ) Notice: Subject to any disclaimer, the term of this patent is extended or adjusted under 35 U.S.C. 154(b) by 242 days.

(21) Appl. No.: 16/672,493

(22) Filed: Nov. 3, 2019

(65) Prior Publication Data

US 2021/0128963 A1 May 6, 2021

(51) Int. Cl.
*A63B 21/002* (2006.01)
*A63B 21/00* (2006.01)
(Continued)

(52) U.S. Cl.
CPC ..... *A63B 21/0023* (2013.01); *A63B 21/063* (2015.10); *A63B 21/0632* (2015.10); *A63B 21/151* (2013.01); *A63B 21/4034* (2015.10); *A63B 21/4035* (2015.10); *A63B 24/0062* (2013.01); *A63B 24/0075* (2013.01); *A63B 71/0622* (2013.01); *A63B 2071/0625* (2013.01); *A63B 2071/0658* (2013.01); *A63B 2071/0675* (2013.01); *A63B 2208/0233* (2013.01); *A63B 2220/52* (2013.01); *A63B 2220/808* (2013.01);
(Continued)

(58) Field of Classification Search
CPC ..... A63B 21/0023; A63B 21/063; A63B 21/0632; A63B 21/151; A63B 21/4034; A63B 21/4035; A63B 24/0062; A63B 24/0075; A63B 71/0622; A63B 2071/0625; A63B 2071/0658; A63B 2071/0675; A63B 2208/0233; A63B 2220/52; A63B 2220/808; A63B 2220/833; A63B 2225/50; A63B 2230/06; A63B 2230/207; A63B 2230/30; A63B 2230/42; A63B 2230/50; A63B 2024/0093; A63B 24/0087; A63B 21/0628; A63B 2023/0411; A63B 2071/009; A63B 2209/00; A63B 2209/02; A63B 2220/51; A63B 2220/80; A63B 2220/806; A63B 2225/09; A63B 2225/15; A63B 2225/20; A63B 2230/436
See application file for complete search history.

(56) References Cited

U.S. PATENT DOCUMENTS 5,151,071 A * 9/1992 Jain ..... A63B 21/154 482/101
5,213,556 A * 5/1993 Boren ..... A63B 21/0628 482/100
(Continued)

*Primary Examiner* — Sundhara M Ganesan
(74) *Attorney, Agent, or Firm* — Pharar Patents & Intellectual Property; Andrew A. Pharar

(57) ABSTRACT

The therapeutic isometric testing and isotonic training exercise device disclosed herein may allow for isometric strength testing and isometric and isotonic strength training of a user to prevent or treat soft and connective tissue deficiencies. The device may comprise, generally, a leg press, chest press, and shrug press exercise device combination having a plurality of electronic components. The device may comprise a seat assembly and weight stack assembly connected to an articulating frame, and may further comprise a weight locking pin and a plurality of load sensors for user work measurements. A proprietary software may be integrated into the device, and each user may have a personal user account and customized training regimen designed for them based on system inputs and readings.

16 Claims, 5 Drawing Sheets

(51) Int. Cl.
*A63B 21/062* (2006.01)
*A63B 71/06* (2006.01)
*A63B 24/00* (2006.01)

(52) U.S. Cl.
CPC ..... *A63B 2220/833* (2013.01); *A63B 2225/50* (2013.01); *A63B 2230/06* (2013.01); *A63B 2230/207* (2013.01); *A63B 2230/30* (2013.01); *A63B 2230/42* (2013.01); *A63B 2230/50* (2013.01)

(56) References Cited

U.S. PATENT DOCUMENTS 5,217,422 A * 6/1993 Domzalski ..... A63B 21/154 482/100
5,331,851 A * 7/1994 Parviainen ..... A63B 21/4011 73/379.01
6,120,416 A * 9/2000 Walker ..... A63B 21/0023 482/51
9,707,435 B1 * 7/2017 Ferlito ..... A63B 21/063
2005/0049122 A1 * 3/2005 Vallone ..... A63B 21/00069 482/128
2006/0135325 A1 * 6/2006 Holness ..... A63B 24/00 482/94
2006/0293151 A1 * 12/2006 Rast ..... A63B 21/0023 482/8
2008/0248926 A1 * 10/2008 Cole ..... A63B 21/0628 482/5
2012/0220429 A1 * 8/2012 Yoshida ..... A63B 24/0062 482/8
2012/0283074 A1 * 11/2012 Hutchins ..... A63B 23/0233 482/98
2013/0102440 A1 * 4/2013 Hutchins ..... A63B 24/0062 482/8
2014/0077945 A1 * 3/2014 Amagai ..... A61B 5/486 340/539.11
2015/0290489 A1 * 10/2015 Simmons ..... A63B 24/0087 482/91
2016/0361597 A1 * 12/2016 Cole ..... A63F 13/245
2017/0056707 A1 * 3/2017 Hockridge ..... A63B 21/156
2017/0080287 A1 * 3/2017 Jaquish ..... G16H 20/30
2017/0106235 A1 * 4/2017 Carter ..... A63B 21/154
2017/0282015 A1 * 10/2017 Wicks ..... A63B 21/0058
2018/0326241 A1 * 11/2018 Huskins ..... A63B 23/0417
2019/0033148 A1 * 1/2019 Goodstadt ..... A61B 5/6895
2019/0111299 A1 * 4/2019 Radcliffe ..... A61H 1/024
2019/0282848 A1 * 9/2019 Meredith ..... A63B 23/0405
2020/0078636 A1 * 3/2020 Svatkova Hoeven ..... A63B 24/0075
2020/0188726 A1 * 6/2020 Carter ..... A63B 21/4033
2020/0222748 A1 * 7/2020 Carter ..... A63B 21/00069
2020/0397639 A1 * 12/2020 Mason ..... A63B 21/4029

* cited by examiner

THERAPEUTIC ISOMETRIC TESTING AND ISOTONIC TRAINING EXERCISE DEVICE

TECHNICAL FIELD OF THE INVENTION

The present invention relates in general to exercise devices, and, more specifically, to a therapeutic isometric testing and isotonic training exercise device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

The term isometric translates from the Greek language and means "having equal measurement." An isometric exercise is a form of exercise involving the static contraction of a muscle without any visible movement in the angle of the joint. The three main types of isometric exercise are isometric presses, pulls, and holds. They may be included in a strength training regime in order to improve the body's ability to apply power from a static position or, in the case of isometric holds, improve the body's ability to maintain a position for a period of time. Considered as an action, isometric presses are also of fundamental importance to the body's ability to prepare itself to perform immediately subsequent power movements. Such preparation is also known as isometric preload.

The term isotonic translates from the Greek language and means "taking place with normal contraction." In an isotonic contraction, tension remains the same, while the muscle's length changes. Isotonic contractions differ from isokinetic contractions in that in isokinetic contractions the muscle speed remains constant. While superficially identical, as the muscle's force changes via the length-tension relationship during a contraction, an isotonic contraction will keep force constant while velocity changes, but an isokinetic contraction will keep velocity constant while force changes.

There are two types of isotonic contractions: concentric and eccentric. In a concentric contraction, the muscle tension rises to meet the resistance, then remains the same as the muscle shortens. In eccentric, the muscle lengthens due to the resistance being greater than the force the muscle is producing.

A soft tissue injury, especially injuries to the muscles and connective tissues, includes sprains and strains, which are the most common injuries for people engaged in physical sports or involved in milder traumas. A sprain is an injury of a ligament, the structures connecting various bones to their neighboring bones. A strain is an injury that can occur to a muscle, the structures driving the various bones, or a tendon, the structures connecting the muscles to the bones.

Most muscle strains happen for one of two reasons: either the muscle has been stretched beyond its limits or it has been forced to contract too strongly. In mild cases, only a few muscle fibers are stretched or torn, and the muscle remains intact and strong. In severe cases, however, the strained muscle may be torn and unable to function properly.

A hard tissue injury affects the bones of the body, and can include any of the types of "broken bones," including a closed fracture, an open fracture, or a complicated fracture. All hard tissue injuries are related to traumatic forces applied to the bones, and the healing time for most fractures is measured in months. The effectiveness of the healing is based heavily on correctly placing and immobilizing the fractured bone, and the likelihood of scar tissue formation and other complications limiting the complete resolution of the fracture is very high.

Osteoporosis is, usually, an age-related disease in which the density and quality of a person's bones are reduced. As the bones become more porous and fragile, the risk of bone fracturing is significantly increased. The loss of bone occurs progressively and, often, without warning until a first fracture occurs. The classic osteoporosis-related bone fracture is a hip fracture, usually after a fall, and prevailing therapeutic protocols emphasize the prevention of falling and other behaviors that exert strong forces on the weakened bones to reduce the likelihood of fractures.

A number of exercises have been studied and shown to reduce the progression of and benefit the recovery from various soft and connective tissue injuries, though most of the recommended exercise are isometric in nature, meaning they are intended to enhance muscle strength and muscle mass. Instead, protocols are needed that emphasize the regeneration and stimulation of the connective tissues to prevent injury and fractures by combining isometric and isotonic exercises on a regimen customized to each user.

Thus, there is a need in the art for a therapeutic isometric testing and isotonic training exercise device. It is to these ends that the present invention has been developed.

BRIEF SUMMARY OF THE INVENTION

To minimize the limitations in the prior art, and to minimize other limitations that will be apparent upon reading and understanding the present specification, the present invention describes a therapeutic isometric testing and isotonic training exercise device.

It is an objective of the present invention to provide a therapeutic isometric testing and isotonic training exercise device that may comprise a leg press exercise device.

It is another objective of the present invention to provide a therapeutic isometric testing and isotonic training exercise device that may comprise a chest press exercise device.

It is another objective of the present invention to provide a therapeutic isometric testing and isotonic training exercise device that may comprise a shrug pull exercise device.

It is another objective of the present invention to provide a therapeutic isometric testing and isotonic training exercise device that may comprise an isometric strength testing device.

It is another objective of the present invention to provide a therapeutic isometric testing and isotonic training exercise device that may comprise an isometric and isotonic strength training device.

It is another objective of the present invention to provide a therapeutic isometric testing and isotonic training exercise device that may comprise an articulating frame.

It is another objective of the present invention to provide a therapeutic isometric testing and isotonic training exercise device that may comprise a seat assembly.

It is another objective of the present invention to provide a therapeutic isometric testing and isotonic training exercise device that may comprise a frame load sensor.

It is another objective of the present invention to provide a therapeutic isometric testing and isotonic training exercise device that may comprise a weight assembly.

It is another objective of the present invention to provide a therapeutic isometric testing and isotonic training exercise device that may comprise a plurality of weights.

It is another objective of the present invention to provide a therapeutic isometric testing and isotonic training exercise device that may comprise a weight locking pin.

It is another objective of the present invention to provide a therapeutic isometric testing and isotonic training exercise device that may comprise a weight load sensor.

It is another objective of the present invention to provide a therapeutic isometric testing and isotonic training exercise device that may comprise a plurality of physiological sensors.

It is another objective of the present invention to provide a therapeutic isometric testing and isotonic training exercise device that may comprise a weight sensor.

It is another objective of the present invention to provide a therapeutic isometric testing and isotonic training exercise device that may comprise a temperature sensor.

It is another objective of the present invention to provide a therapeutic isometric testing and isotonic training exercise device that may comprise a blood pressure sensor.

It is another objective of the present invention to provide a therapeutic isometric testing and isotonic training exercise device that may comprise a pulse rate sensor.

It is another objective of the present invention to provide a therapeutic isometric testing and isotonic training exercise device that may comprise a breathing rate sensor.

It is another objective of the present invention to provide a therapeutic isometric testing and isotonic training exercise device that may comprise a pulse oximetry sensor.

It is another objective of the present invention to provide a therapeutic isometric testing and isotonic training exercise device that may comprise a proprietary software.

It is another objective of the present invention to provide a therapeutic isometric testing and isotonic training exercise device that may comprise a computing device.

It is another objective of the present invention to provide a therapeutic isometric testing and isotonic training exercise device that may comprise a central database.

It is another objective of the present invention to provide a therapeutic isometric testing and isotonic training exercise device that may comprise an interactive training program.

It is another objective of the present invention to provide a therapeutic isometric testing and isotonic training exercise device that may comprise a biofeedback program.

It is another objective of the present invention to provide a therapeutic isometric testing and isotonic training exercise device that may comprise a plurality of user accounts.

It is another objective of the present invention to provide a therapeutic isometric testing and isotonic training exercise device that may comprise a personalized training program.

It is another objective of the present invention to provide a therapeutic isometric testing and isotonic training exercise device that may comprise a plurality of progress reports.

It is another objective of the present invention to provide a therapeutic isometric testing and isotonic training exercise device that may comprise a resilient material of construction.

It is another objective of the present invention to provide a therapeutic isometric testing and isotonic training exercise device that may comprise a flexible material of construction.

It is another objective of the present invention to provide a therapeutic isometric testing and isotonic training exercise device that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Figure 1:
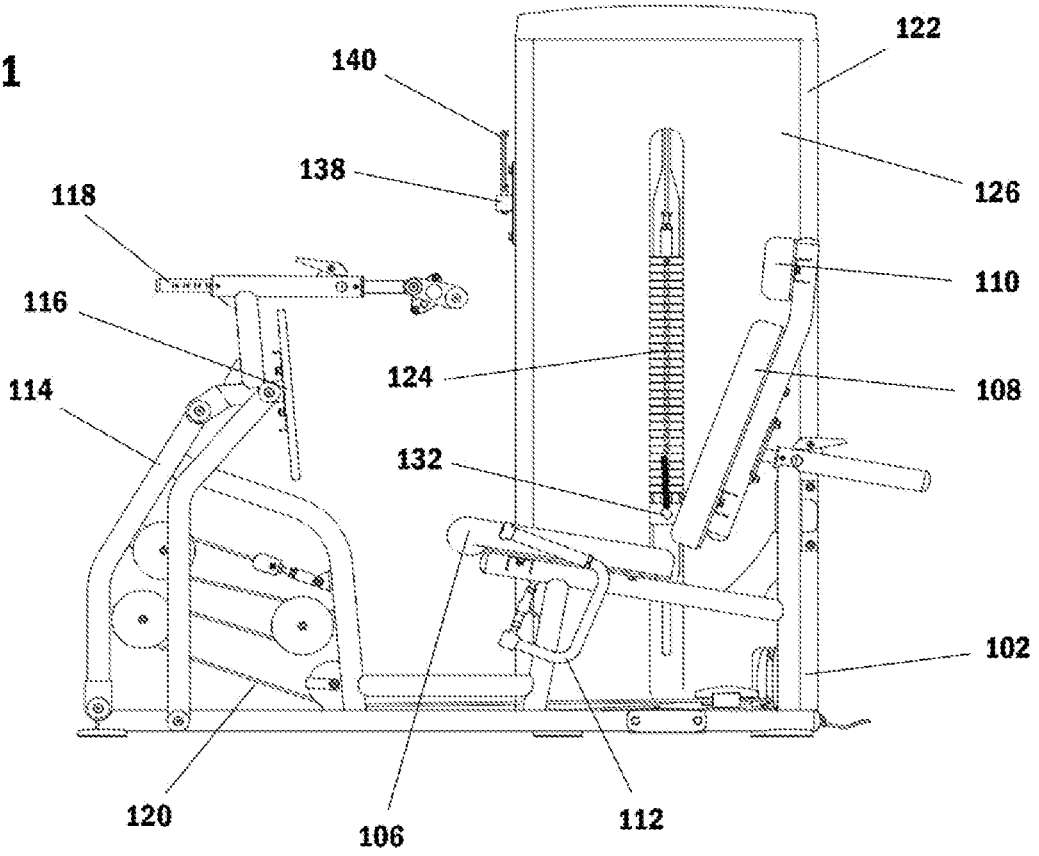
FIG. 1 is a left side perspective view of a therapeutic isometric testing and isotonic training exercise device, as contemplated by the present disclosure.
Figure 2:
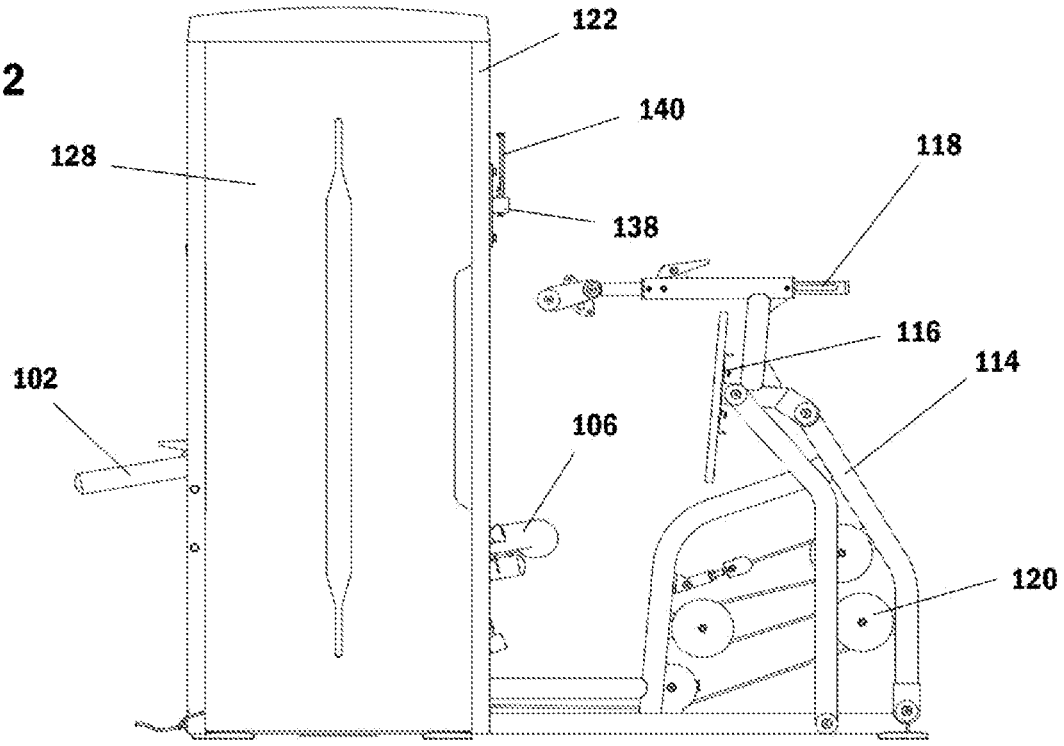
FIG. 2 is a right side perspective view of a therapeutic isometric testing and isotonic training exercise device, as contemplated by the present disclosure.
Figure 3:
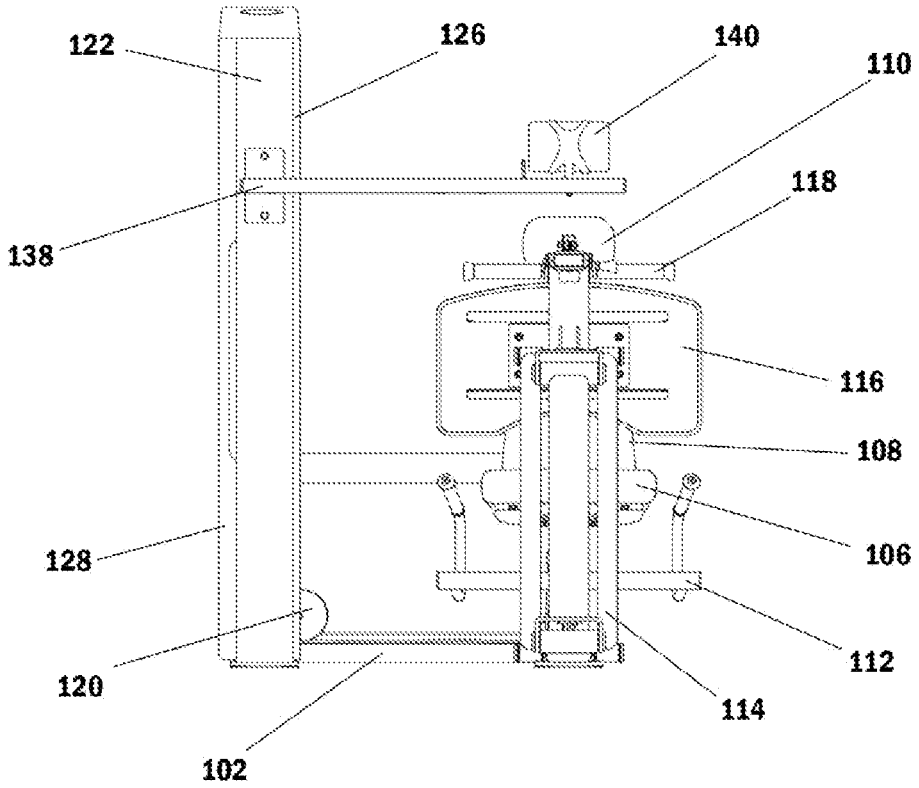
FIG. 3 a front perspective view of a therapeutic isometric testing and isotonic training exercise device, as contemplated by the present disclosure.
Figure 4:
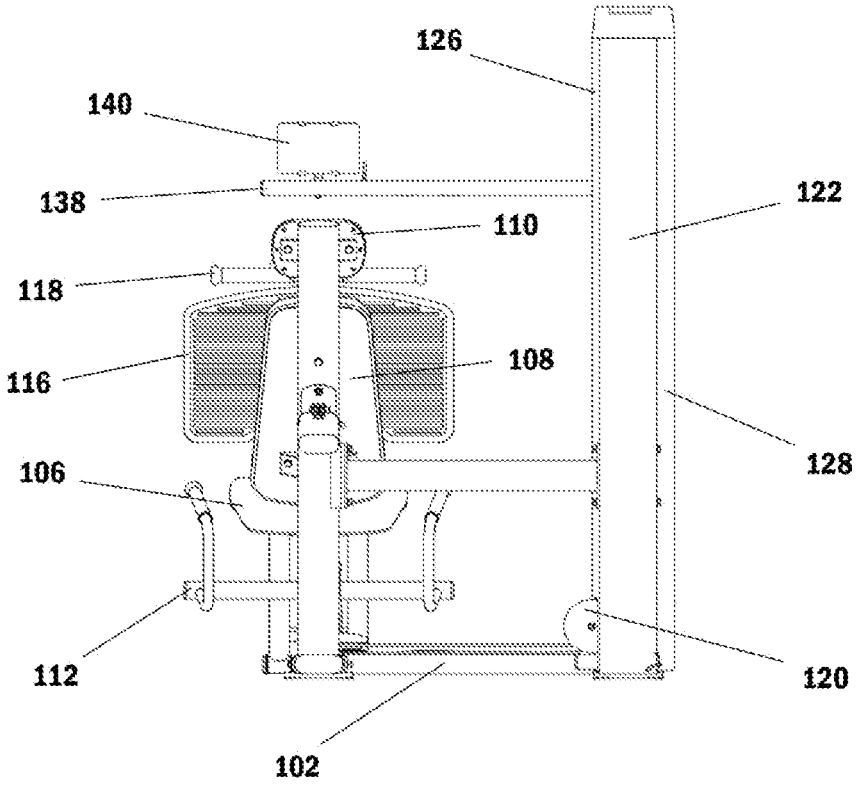
FIG. 4 is a rear perspective view of a therapeutic isometric testing and isotonic training exercise device, as contemplated by the present disclosure.
Figure 5:
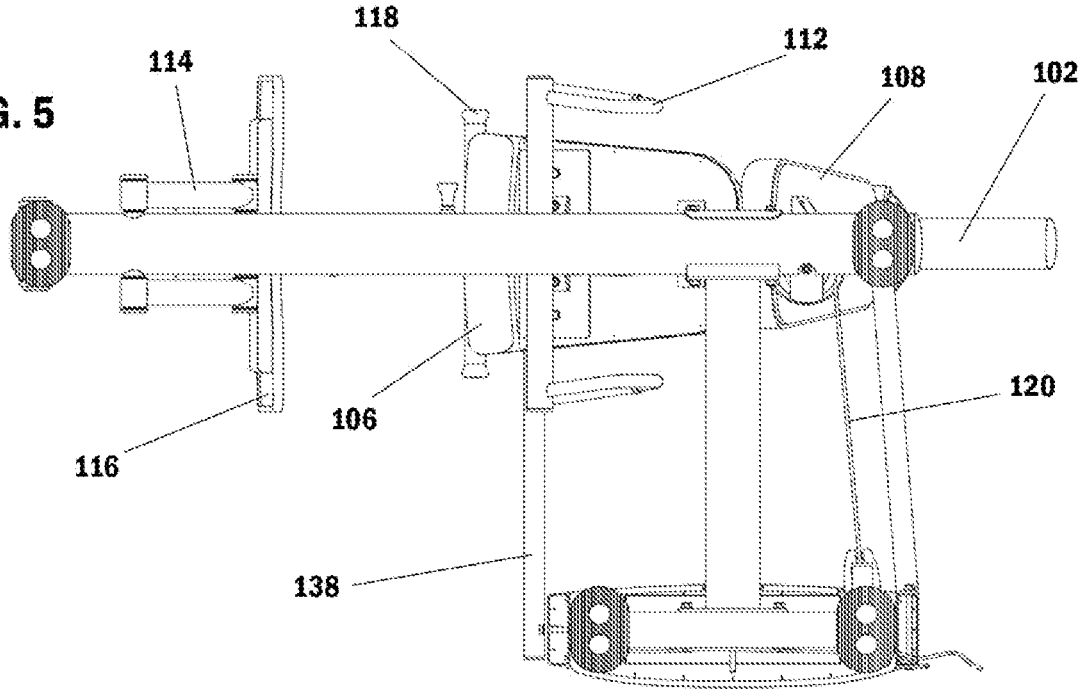
FIG. 5 is a bottom perspective view of a therapeutic isometric testing and isotonic training exercise device, as contemplated by the present disclosure.
Figure 6:
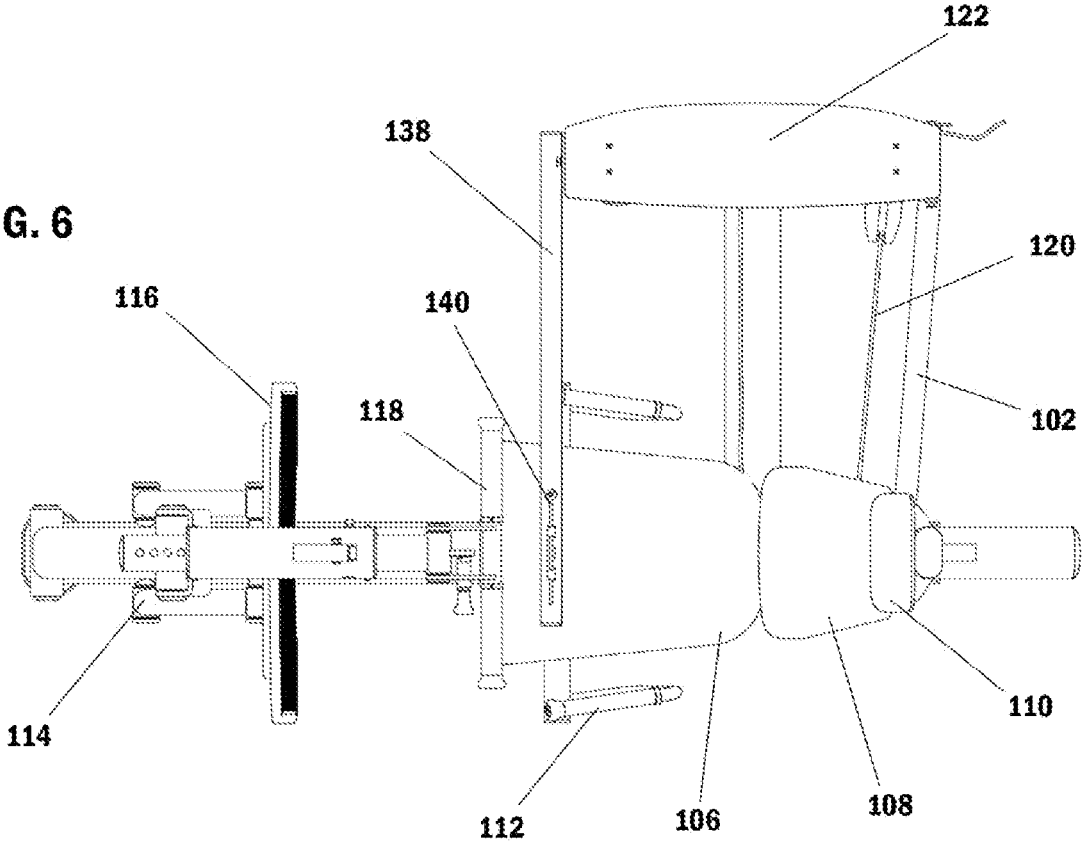
FIG. 6 is a top perspective view of a therapeutic isometric testing and isotonic training exercise device, as contemplated by the present disclosure.
Figure 7:
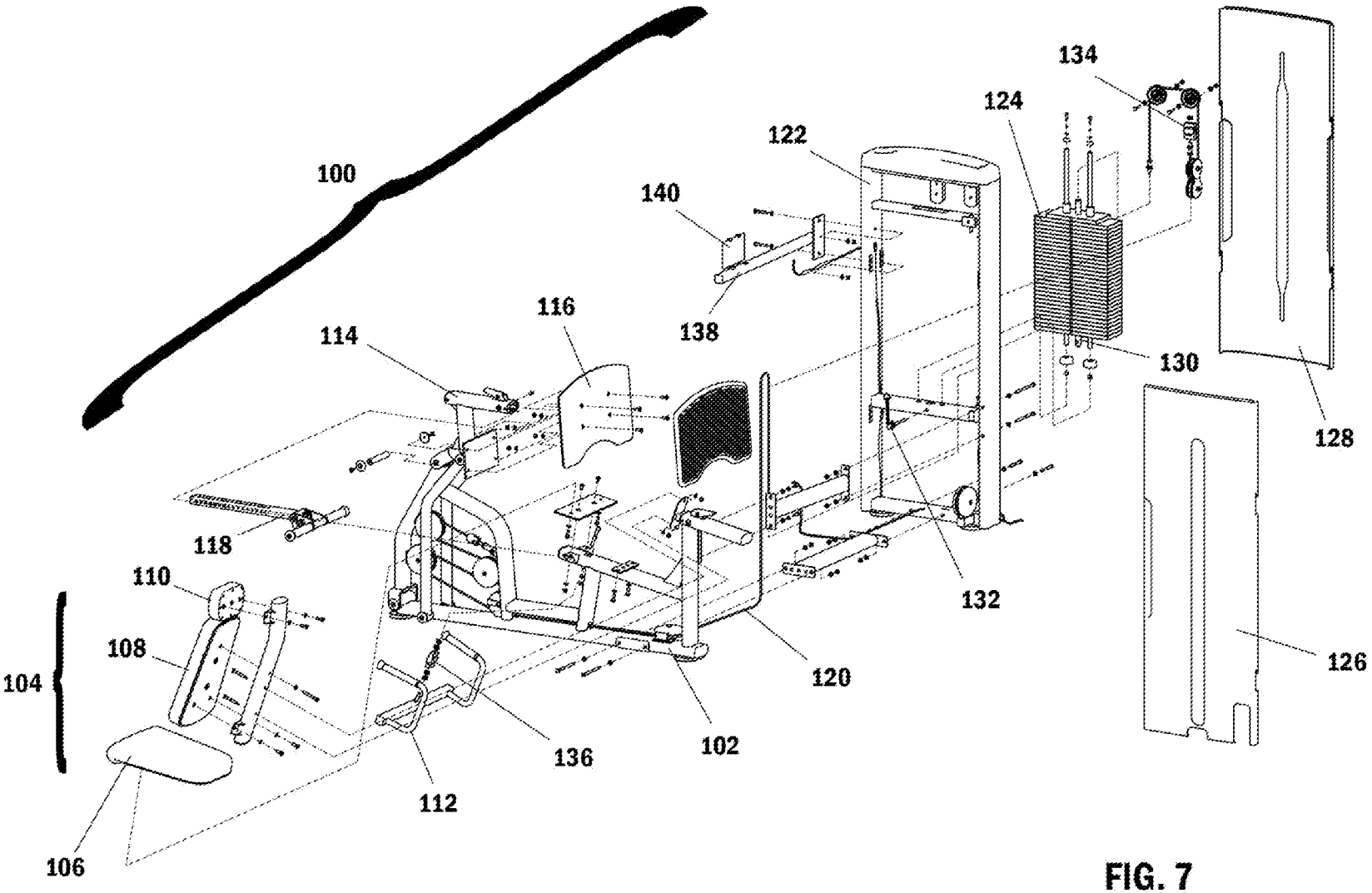
FIG. 7 is an exploded isometric perspective view of a therapeutic isometric testing and isotonic training exercise device, as contemplated by the present disclosure.

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The therapeutic isometric testing and isotonic training exercise device disclosed herein may allow for isometric strength testing and isometric and isotonic strength training of a user to prevent or treat soft and connective tissue deficiencies. The device may comprise, generally, a leg press, chest press, and shrug pull exercise device combination having a plurality of electronic components. The device may comprise a seat assembly and weight stack assembly connected to an articulating frame, and may further comprise a weight locking pin and a plurality of load sensors for user work measurements. A proprietary software may be integrated into the device, and each user may have a personal user account and customized training regimen designed for them based on system inputs and readings.

The device may provide a system beneficial for the regeneration and stimulation of both soft and connective tissues, including the bones, tendons, muscles, and ligaments. The device may measure real time forces and provide real time visual feedback to a user, and may walk a user through a personalized therapy protocol after calculating a strength training target weight based on isometric strength results.

A weight stack may be integrated into the device so as to permit increasing strength and load testing abilities. A locking pin may be integrated into the weight stack to permit isometric exercises, and a plurality of load sensors may be integrated to permit the system to take work measurements and provide feedback in real time.

The proprietary software may track a user's progress and provide progress reports and other biofeedback to the user. The device may further comprise wireless connectivity connecting it to a central database for user data storage, analysis, and portability. In this way a user of a first device may continue their training regimen on a second device by logging into their account on the second device, eliminating the need to reinput or reprogram their training protocol while maintaining the personalized nature of the exercise program.

The device may further integrate a plurality of sensors for additional functionality, such as weight, temperature, and physiological sensors for measuring, for example, body weight, body temperature, blood pressure, pulse rate, breathing rate, pulse oximetry, and any other appropriate parameters.

The illustrations of FIGS. 1-7 illustrate a therapeutic isometric testing and isotonic training exercise device, as contemplated by the present disclosure. The device may comprise, in the aggregate, a main body 100 which may be composed of the various subassemblies needed to implement the various features of the device. At the root of the device may be a primary frame 102, which may be any appropriately-shaped frame designed for supporting and receiving the additional components of the device. The primary frame 102 may comprise, for example, a plurality of hollow tubes or bars having a substantially square, rectangular, circular, or ovular cross section, as appropriate. The various tubes or bars may be attached to one another by any appropriate means such as, for example, nuts and bolts, clips, screws, quick-release connectors, or welds.

In one embodiment the primary frame 102 may receive a seat assembly 104, which may comprise a seat having a seat pad 106, a seat back 108, and a seat headrest 110. The seat pad 106, seat back 108, and seat headrest may be attached to each other or may be attached to a subframe attached to the primary frame 102, and the various components may be adjustable to accommodate users of various sizes and needs. The seat assembly 104 may further comprise a seat handle 112, which may be attached to the seat pad 106 or a subframe attached to the primary frame 102, and which may comprise a plurality of hand holds positioned on either side of the user's sitting position. In this way the user may support and brace themselves by holding the seat handle 112 when sitting on the seat pad 106.

In another embodiment the primary frame 102 may receive an articulating frame 114, which may be any appropriately-shaped frame designed for supporting and receiving the leg press components of the device. The articulating frame 114 may comprise, for example, a plurality of hollow tubes or bars having a substantially square, rectangular, circular, or ovular cross section, as appropriate. The various tubes or bars may be attached to one another by any appropriate means such as, for example, nuts and bolts, clips, screws, quick-release connectors, or welds.

Attached to the articulating frame 114 may be a foot plate 116, which may comprise a plate large enough for a user to place their feet against, and may further comprise a rubberized surface, or other appropriate surface, for providing additional traction to a user and improved wear characteristics to the device. An articulating handle 118, which may comprise a plurality of handholds, may also be attached to the articulating frame 114 above, below, or otherwise near the foot plate 116. In this way the user may support and brace themselves by holding the articulating handle 118 when sitting on the seat pad 106.

Connecting the various components and subsystems of the main body 100 may be a cable system 120, which may comprise a plurality of cables and pulleys attached to the various articulating and moving components of the system. By including such a cable system 120 a user may exert torque and force on the foot plate 116, seat handle 112, articulating handle 118, and a plurality of weights 124 to perform the various exercises of the system.

In another embodiment the primary frame 102 may receive a weight frame 122, which may be any appropriately-shaped frame designed for supporting and receiving a plurality of weights 124 of the device. The weight frame 122 may comprise, for example, a plurality of hollow tubes or bars having a substantially square, rectangular, circular, or ovular cross section, as appropriate. The various tubes or bars may be attached to one another by any appropriate means such as, for example, nuts and bolts, clips, screws, quick-release connectors, or welds.

Attached to the weight frame 122 may be a weight rod designed to carry and lift the plurality of weights 124 based on user effort. The weight frame 122 may be enclosed by an inner shroud 126 and an outer shroud 128, which may be any shroud appropriate to improving the overall aesthetics of the device and preventing injuries to a user of the system from the moving plurality of weights 124.

The weight rod may pass through the plurality of weights 124 into a weight-bearing crossmember. The weight rod may further comprise a locking pin receiver 130, which may allow a locking pin 132 to be inserted and to prevent movement of the weight rod and the plurality of weights 124. The locking pin 132 may be inserted through the weight-bearing crossmember into the weight rod to lock and prevent the movement of the plurality of weights 124.

To begin using the therapeutic isometric testing and isotonic training exercise device a user may first sit on the seat assembly 104. To perform a leg press exercise using the device a user may position their feet against the foot plate 116 and may use their hands to grip the seat handle 112. The user may then press against the foot plate 116 to either lift the plurality of weights 124 or press against the locking pin 132, when engaged. In this way the user may perform an isometric or isotonic leg press exercise, depending on whether or not the locking pin 132 is engaged.

To perform a chest press exercise using the device a user may use their hands to grip the articulating handle 118. The user may then press against the articulating handle 118 to either lift the plurality of weights 124 or press against the locking pin 132, when engaged. In this way the user may perform an isometric or isotonic chest press exercise, depending on whether or not the locking pin 132 is engaged.

To perform a shrug pull exercise using the device a user may use their hands to grip the seat handle 112. The user may then pull against the seat handle 112 to either lift the plurality of weights 124 or pull against the locking pin 132, when engaged. In this way the user may perform an isometric or isotonic shrug pull exercise, depending on whether or not the locking pin 132 is engaged.

In another embodiment the therapeutic isometric testing and isotonic training exercise device may comprise a plurality of load sensors for measuring work, exercise, and forces generated by a user of the device. A first load sensor, which may be a weight load sensor 134, may be attached to the plurality of weights 124 to measure the amount of force being generated to lift the plurality of weights 124 when they are unlocked. The weight load sensor 134 may also be attached to the plurality of weights 124 such that the weight load sensor 134 measures the amount of force being exerted by the user against the plurality of weights 124 when locked by the locking pin 132.

A second load sensor, which may be a frame load sensor 136, may be attached to the primary frame 102 to measure the amount of force being generated to lift the plurality of weights 124 when they are unlocked. The frame load sensor 136 may also be attached to the primary frame 102 such that the weight load sensor 134 measures the amount of force being exerted by the user against the foot plate 116, the articulating handle 118, or the seat handle 112 when the plurality of weights 124 are locked by the locking pin 132.

In another embodiment the primary frame 102 may receive a display frame 138, which may be any appropriately-shaped frame designed for supporting and receiving an interactive display 138 of the device. The display frame 138 may comprise, for example, a plurality of hollow tubes or bars having a substantially square, rectangular, circular, or ovular cross section, as appropriate. The various tubes or bars may be attached to one another by any appropriate means such as, for example, nuts and bolts, clips, screws, quick-release connectors, or welds.

The therapeutic isometric testing and isotonic training exercise device may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the therapeutic isometric testing and isotonic training exercise device may be substantially constructed of one or more materials of plastic, acrylic, polycarbonate, steel, aluminum, brass, fiberglass, carbon fiber, or combinations thereof. In some embodiments the various components of the device may be coated, lined, or otherwise insulated to prevent contamination of the device. In one embodiment the material of construction may vary from one component to the next within the system.

In one embodiment the therapeutic isometric testing and isotonic training exercise device may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

In another embodiment the therapeutic isometric testing and isotonic training exercise device may comprise a proprietary software for displaying various data points, analyzing inputs from the various sensors, and directing a customized training regimen for a given user. The software may be interacted with by the interactive display 140, which may comprise a touchscreen display or which may further comprise a physical input device, such as a keyboard or mouse. The software may display, via the interactive display 140, a user interface through which a user may log in to the system, may view their progress reports, may view their current workout regimen, or may view a plurality of data points from the various sensors of the system.

The various sensors of the therapeutic isometric testing and isotonic training exercise device may include, for example, a plurality of load sensors, a body weight sensor, a body temperature sensor, a blood pressure sensor, a pulse rate sensor, a breathing rate sensor, a pulse oximetry sensor, and any other appropriate sensors. The various sensors may be installed onto the primary frame 102, as appropriate, and be worn and used by a user of the device while exercising. The proprietary software may receive various data points from these various sensors, and track their progression over time and consider their effect on the exercise regimen of the user. The proprietary software may adjust and propose a training regimen to the user based on present data readings, past data readings, and a progression of data readings over time.

To begin using the system a user may access the proprietary software by accessing the interactive display 140 of the device, and may then log into the system via the system user interface. The log in process may involve the user selecting a unique username and password and establishing a plurality of user settings.

Inputs to the system user interface may be made by any appropriate means such as, for example, text-based input or voice-based input. In an embodiment comprising text-based input, the user may type queries and commands into the user interface using any appropriate input source, such as a physical or virtual keyboard or a smartphone or tablet device connected to the system, whether physically or wirelessly. In an embodiment comprising voice-based input the user may interact with the system using a microphone, whether individually or integrated into a smartphone or tablet device, and the system may comprise speech recognition and language interpretation components to understand and interpret the input.

To protect the various user accounts, user data, and transactions stored within the system it is contemplated that the proprietary software may implement modern data security and encryption protocols. By way of example, the proprietary software may implement the advanced encryption standard (AES), the triple data encryption standard (3DES), the twofish standard, the Rivest, Shamir, Adelman standard (RSA), or any other appropriate encryption protocol. It is contemplated that the proprietary software may implement, at least, 128-bit encryption, though more difficult encryption, such as, for example, 206-bit or 256-bit, may be implemented as desired.

The system may further comprise features commonly implemented in social networking systems for convenience, portability, and ease of use. The system may, for example, be able to network with social networking sites, such as Facebook or LinkedIn, to grab a user's demographic information and autopopulate their profile. The user may then review such entries and modify the parameters as appropriate before setting their profile. The user may also revise or change their selected parameters at any time after their initial registration. The system may also capture a user's images from the social networking sites, if desired, so that the user may add a plurality of profile pictures to their profile. In the same vein, the system may post a user's information, if desired, to the social networking sites.

Figure 8:
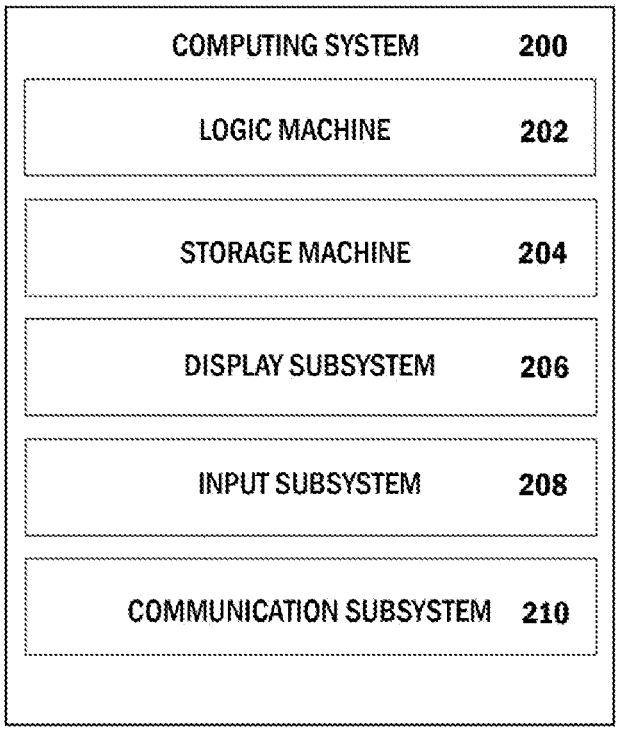
FIG. 8 schematically presents a computing system configured to carry out and actualize methods and tasks described herein, as contemplated by the present disclosure.

The illustration of FIG. 8 schematically presents a computing system that may represent an embodiment of the present invention. In some embodiments the method is executed on a computing system such as computing system 200. For example, storage machine 204 may hold instructions executable by logic machine 202 to provide the method to users.

Display subsystem 206 may display the various elements of the method to participants. For example, display subsystem 206, storage machine 204, and logic machine 202 may be integrated such that the method may be executed while being displayed on a display screen. The input subsystem 208 may receive user input from participants to indicate the various choices or user inputs described above.

The described method may be executed, provided, or implemented to a user on one or more computing devices via a computer-program product such as via an application programming interface (API). Computing system 200 may be any appropriate computing device such as a personal computer, tablet computing device, gaming device or console, mobile computing device, etc. Computing system 200 includes a logic machine 202 and a storage machine 204. Computing system 200 may include a display subsystem 206, input subsystem 208, and communication subsystem 210.

Logic machine 202 may execute machine-readable instructions via one or more physical devices. For example, the logic machine 202 may be configured to execute instructions to perform tasks for a computer program. The logic machine may include one or more processors to execute machine-readable instructions.

Storage machine 204 includes one or more physical devices configured to hold or store instructions executable by the logic machine to implement the method. When such methods and processes are implemented, the state of storage machine 204 may be changed to hold different data. For example, storage machine 204 may include memory devices such as various hard disk drives or CD or DVD devices.

Display subsystem 206 may visually present data stored on storage machine 204. For example, display subsystem 206 may visually present data to form a graphical user interface (GUI). Input subsystem 208 may be configured to connect and receive input from devices such as a mouse, keyboard, or gaming controller. Communication subsystem 210 may be configured to enable system 200 to communicate with other computing devices. Communication subsystem 210 may include wired and/or wireless communication devices to facilitate networked communication.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A therapeutic isometric testing and isotonic training exercise device, comprising:

a primary frame;
a seat assembly;
a seat handle;
an articulating frame;
an articulating handle;
a weight frame;
a plurality of weights;
a cable system;
a locking pin; and
a plurality of sensors;
wherein said primary frame is attached to said seat assembly, said articulating frame, and said weight frame;
wherein said seat handle is attached to said seat assembly and said primary frame;
wherein said articulating handle is attached to said articulating frame;
wherein said plurality of weights are attached to said weight frame;
wherein said cable system is attached to said articulating frame, said seat handle, and said plurality of weights;
wherein said locking pin is removably attached to said plurality of weights;
wherein said seat assembly further comprises a seat pad, seat back, and seat headrest;
wherein said articulating frame further comprises a foot plate;
wherein said seat handle transmits a user force to said plurality of weights;
wherein said articulating handle transmits said user force to said plurality of weights;
wherein said foot plate transmits said user force to said plurality of weights;
wherein one of said plurality of sensors comprises a weight load sensor; and
wherein one of said plurality of sensors comprises a frame load sensor;
wherein said weight load sensor is attached to said cable system and said plurality of weights; and
wherein said frame load sensor is attached to said cable system and said primary frame.

2. The invention of claim 1, further comprising:

a display frame; and
an interactive display;
wherein said interactive display is attached to said display frame;
wherein said display frame is attached to said primary frame; and
wherein said interactive display displays a plurality of readings from said plurality of sensors.

3. The invention of claim 2, further comprising:

a proprietary software; and
a computing device;
wherein said proprietary software controls said computing device;
wherein said computing device is attached to said primary frame;
wherein said proprietary software receives said plurality of readings from said plurality of sensors; and wherein said proprietary software displays said plurality of readings from said plurality of sensors via said interactive display.

4. The invention of claim 3, wherein said proprietary software receives a plurality of user parameters from a user;

wherein said proprietary software analyzes said plurality of readings from said plurality of sensors in light of said plurality of user parameters to create a personalized training regimen.

5. The invention of claim 4, wherein said personalized training regimen is presented to said user; and wherein said proprietary software constantly evaluates and adjusts said personalized training regimen based on said plurality of readings from said plurality of sensors in light of said plurality of user parameters.

6. The invention of claim 5, further comprising:

a wireless connectivity; and a central database;

wherein said proprietary software is wirelessly connected to said central database.

7. The invention of claim 6, wherein said weight frame further comprises an inner shroud and an outer shroud.

8. The invention of claim 7, wherein one of said plurality of sensors comprises a body weight sensor.

9. The invention of claim 8, wherein one of said plurality of sensors comprises a body temperature sensor.

10. The invention of claim 9, wherein one of said plurality of sensors comprises a blood pressure sensor.

11. The invention of claim 10, wherein one of said plurality of sensors comprises a pulse rate sensor.

12. The invention of claim 11, wherein one of said plurality of sensors comprises a breathing rate sensor.

13. The invention of claim 12, wherein one of said plurality of sensors comprises a pulse oximetry sensor.

14. The invention of claim 13, further comprising:

a plurality of cameras.

15. The invention of claim 14, further comprising:

a plurality of microphones.

16. The invention of claim 15, further comprising:

a plurality of speakers.

* * * * *